United States Patent [19]

Rosenbaum, II

[11] 4,142,666

[45] Mar. 6, 1979

[54] LOCK BOTTOM CARTON

[75] Inventor: Walter J. Rosenbaum, II, Ashtabula, Ohio

[73] Assignee: Inland Container Corporation, Indianapolis, Ind.

[21] Appl. No.: 884,122

[22] Filed: Mar. 7, 1978

[51] Int. Cl.[2] ..... B65D 5/10

[52] U.S. Cl. ..... 229/39 R; 229/41 B

[58] Field of Search ..... 229/41 B, 39 R

[56] References Cited

U.S. PATENT DOCUMENTS

| | | | |
|---|---|---|---|
| 732,071 | 6/1903 | Hartrampf | 229/41 B X |
| 2,879,934 | 3/1959 | Flynn | 229/41 B X |
| 3,229,891 | 1/1966 | Edelman | 229/39 R |
| 3,549,081 | 12/1970 | Nelson | 229/39 R |
| 3,801,001 | 4/1974 | Taylor | 229/39 R |
| 4,040,560 | 8/1977 | Grossman | 229/39 R |
| 4,062,487 | 12/1977 | Bliss | 229/39 R |

*Primary Examiner*—Davis T. Moorhead

*Attorney, Agent, or Firm*—Fitch, Even, Tabin & Luedeka

[57] ABSTRACT

A carton includes bottom flaps that, upon erection of the carton, fold inwardly and interlock to form a strong lock bottom carton ready for immediate loading without the aid of fastening means. The structure allows the carton to be used as a retripper whereby the bottom flaps are folded inwardly as the carton is collapsed to a flat, shipping state with the relation between the interlocked flaps being such as to allow ready return of the lock bottom condition upon re-erection of the carton.

9 Claims, 11 Drawing Figures

Fig. 1.
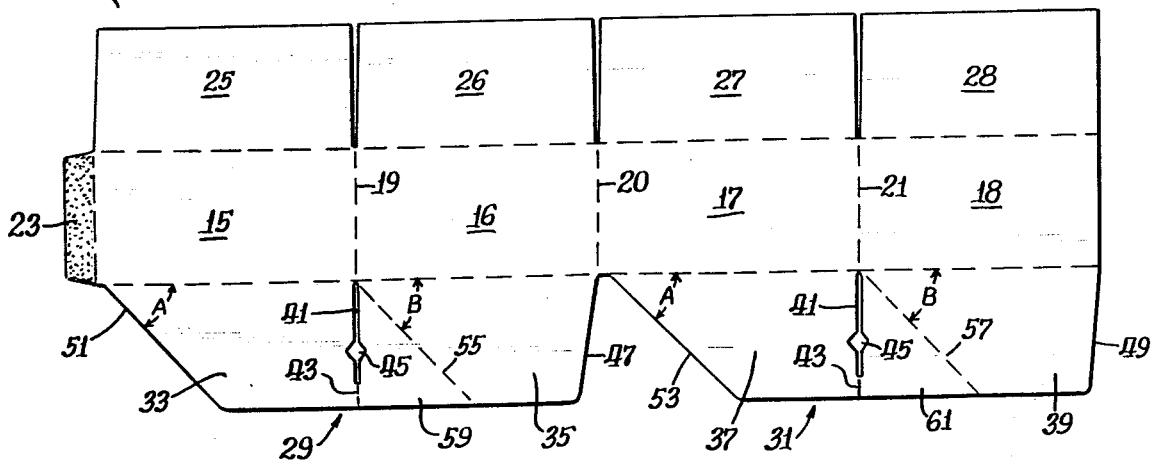
Fig. 2.
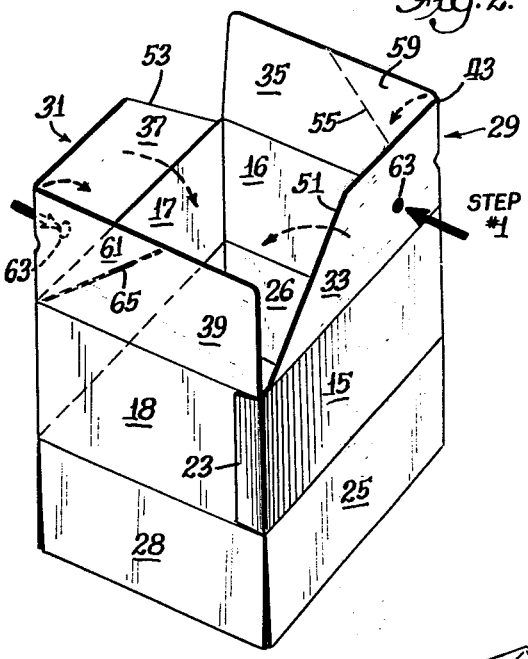
Fig. 3.
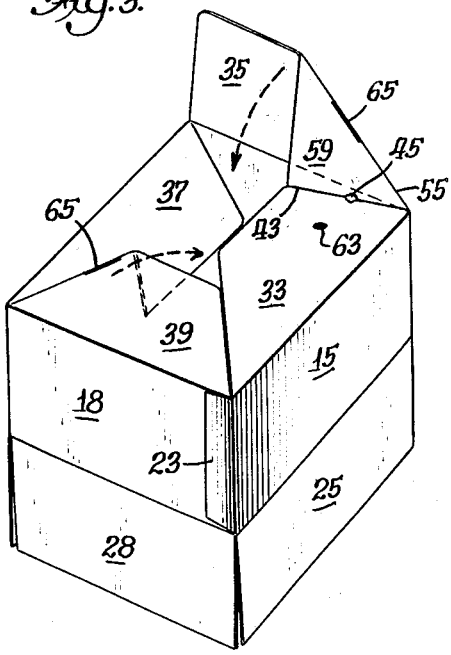
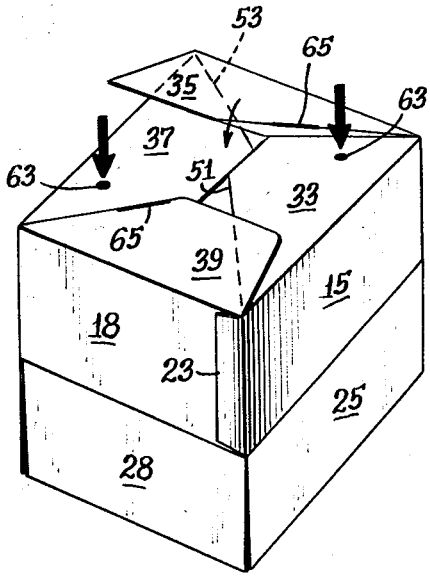
Fig. 4.

Fig. 5.
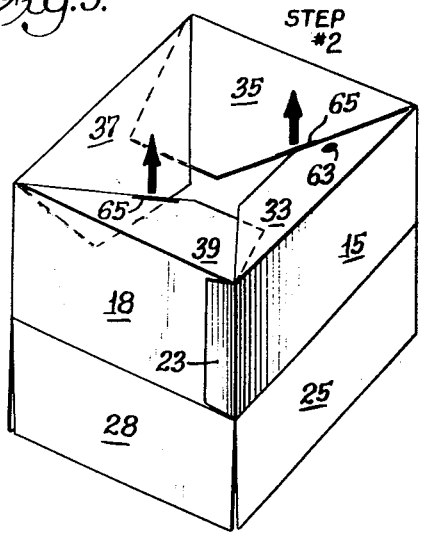
Fig. 6.
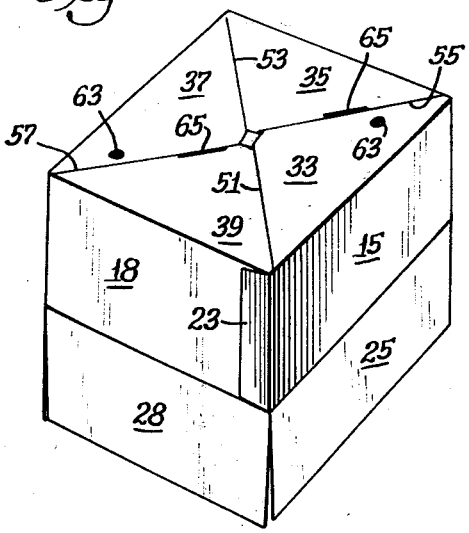
Fig. 7.
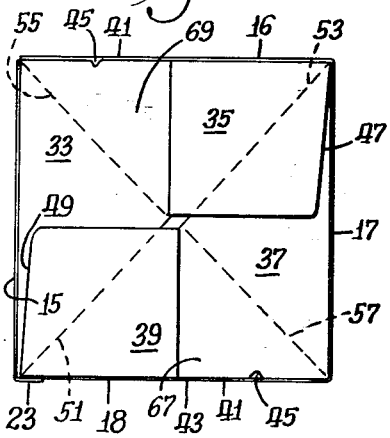
Fig. 8.
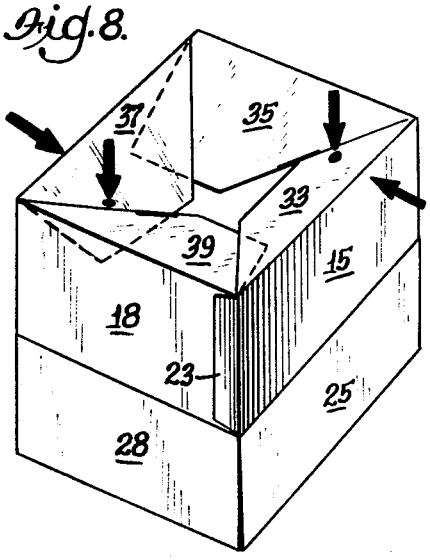
COLLAPSE
Fig. 9.
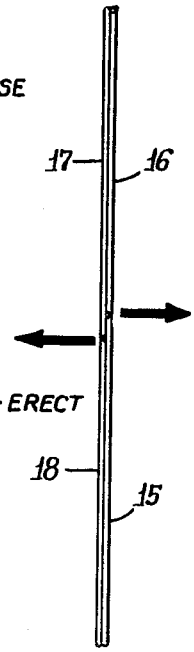
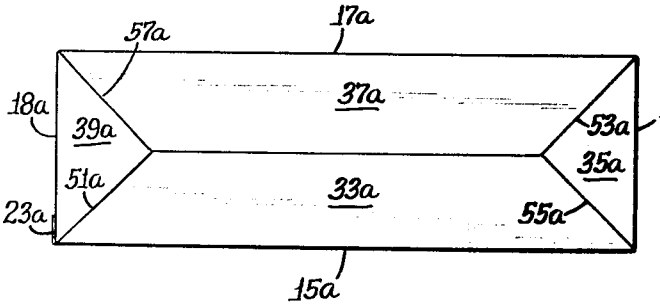
Fig. 10.
Fig. 11.
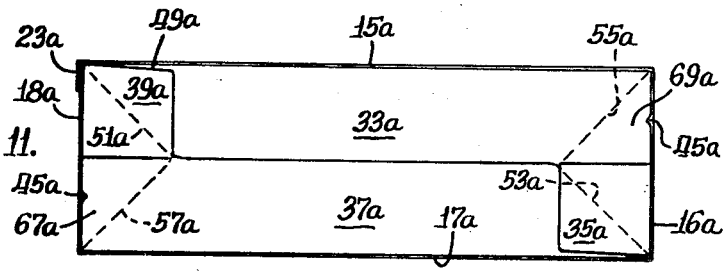

LOCK BOTTOM CARTON

This invention relates generally to shipping containers in the nature of fiberboard cartons.

More particularly, it relates to a carton having flap construction such that the bottom of the carton can be closed and locked securely upon setup of the carton for loading without the need for glue, tape, staples, or other fastening means.

It is familiar experience to manufacture carton blanks, complete the manufacturer's joint to provide a collapsed carton shell in the flat, and shipping a stack of such flats to a user who will then erect the cartons for loading. Generally, several manipulative movements and additional materials, such as staples, tape or glue, are needed to initially erect the cartons, and thereafter, the cartons generally remain in the erected condition for their useful life. Corrugated cartons are known, however, which are of the self-locking type wherein the flap construction is such that the bottom of the box can be closed and locked securely without the use of stitching, tape, rivets or other types of fastening means. Also, cartons that provide automatic bottoms are known. When such automatic cartons are set up to their erected condition for loading, the bottom is automatically deployed in position without the need for manually securing the bottom.

It is desirable to provide such cartons that are easy to manufacture, use less carton material, are strong, and are readily erectable by the user. Furthermore, it is often desired to re-use cartons, and in this connection, it may be desirable to reship the cartons for re-use in a knock-down condition to use the smallest shipping space possible.

It is an object of this invention to provide a lock bottom carton that is easy to manufacture, that minimizes the amount of carton material needed for its size, that is strong, and that is readily erectable by the user.

It is a further object to provide a carton of this type that further includes features allowing ready knock-down for reshipment.

It is yet another object of this invention to provide a carton of this type in which provision is made for manipulating the bottom flaps inwardly for knock-down in one motion while yet retaining a relationship among the bottom flaps that will afford immediate return of the lock bottom upon re-erection.

A principal advantage of the carton construction of this invention over known cartons is the ease with which the user can work with the lock bottom provided in the carton, both initially and later for re-use.

Other objects and advantages of the invention will become apparent and the invention better understood by reference to the following detailed description read in conjunction with the accompanying drawings in which:

FIG. 1 is a plan view of a carton blank constructed in accordance with the principles of this invention;

FIG. 2 is a bottom perspective of the blank of FIG. 1 assembled into a shell and illustrating the initial movements of the bottom flaps during a first step of closing the bottom;

FIG. 3 is a bottom perspective view similar to FIG. 2 and illustrating an advanced condition of the first folding step in closing the bottom;

FIG. 4 is a bottom perspective view illustrating the condition of the bottom flap just prior to the interlocking of the flaps during the first step of folding;

FIG. 5 is a bottom perspective view illustrating the direction of movement of the bottom flaps during a second step of closing the bottom;

FIG. 6 is a bottom perspective view illustrating the bottom of the carton after the closing operation is complete;

FIG. 7 is a top view of the inside bottom of the carton illustrating the relation of the bottom flaps after closing is completed;

FIG. 8 is a bottom perspective view illustrating the direction of manipulation of the bottom flaps and sides in collapsing an erected carton for reshipment in one general motion;

FIG. 9 is a bottom view of the carton in its collapsed tubular condition with bottom folded inwardly and illustrating the direction of forces to re-erect the carton for re-use;

FIG. 10 is a bottom view of the outside of a carton illustrating the relationship of bottom flaps of a long, narrow carton constructed in accordance with the principles of this invention; and FIG. 11 is a top view of the inside bottom of the carton of FIG. 10.

It is contemplated that the carton of this invention will be advantageous for the shipping of articles which are conventionally put in reusable cartons, sometimes known as retrippers. Articles such as potato chips, cookies, bread and other lightweight packages may be in this category.

Briefly, this invention includes a lock bottom carton and blank therefor having alternate side walls and end walls defined by transverse score lines. Standard top flaps are hingedly connected to the top of each of these walls. A glue flap is provided at the free side edge one wall at one end of the blank to form a manufacturer's joint, and a bottom flap having a folded portion and an unfolded portion is hingedly connected at the bottom of one side wall and its adjacent end wall (forming one pair of walls), and a like bottom flap is hingedly connected to the other pair of a side wall and adjacent end wall. The free side edges of the unfolded portions of the bottom flaps have a 45° taper with respect to hinged connections of the flaps, and the folded portions of the bottom flaps each include a score line extending on a 45° taper from the intersection of the hinged connection of the bottom flap and the score line that eventually forms the corner between the end wall and the adjacent side wall pair sharing the same bottom flap. When formed into an erected shell, only two manual steps are needed to fold and lock the bottom into a secure, usable carton having a strong lock bottom. Thereafter, one motion collapsing the bottom flaps internally while at the same time collapsing the tube of perimeter walls allows a quick knock-down condition for reshipping followed by a quick, easy re-erection of the carton with an immediate return of the strong lock bottom.

More specifically, and referring to the drawings in detail, a carton blank 13 constructed in accordance with the principles of this invention is shown in FIG. 1. This blank may be formed of corrugated fiberboard by precision cutting dies in a manner well known in the art. The blank includes alternate side walls 15 and 17 and alternate end walls 16 and 18 joined together and defined by score lines 19, 20 and 21 respectively extending transversely of the longitudinal dimension of the blank that ultimately becomes the perimeter of the erected carton. Extending outwardly from the side edge of the wall 15 is a glue flap 23 used in forming the manufacturer's joint which joins panels 15 and 18 to provide a shell in a collapsed, tubular condition for shipping to users from the point of manufacture. Attached to the top edges of the walls 15 through 18 in the conventional hingedly connected fashion are standard top flaps 25 through 28, respectively. Depending downwardly from the lower or bottom edges of the walls 15 through 18, also in the conventional hingedly connected fashion, are bottom flap 29, depending from walls 15 and 16, and bottom flap 31, depending from walls 17 and 18. Bottom flap 29 includes a major or unfolded portion 33 and a minor or folded portion 35. Similarly, the bottom flap 31 includes a major or unfolded portion 37 and a minor or folded portion 39.

A slot 41 is provided in each of the bottom flaps 29 and 31, namely between the major portion 33 and the minor portion 35 and between the major portion 37 and the minor portion 39. These are internal slots in the sense that they are within the material of the bottom flaps 29 and 31 and are not openended. The axes of the slots (not designated) are directed extensions of the score lines 19 and 21 and so are normal to the hinges. The slots extend from the hinged edge of the bottom flaps transversely thereof by more than half the distance to the free edges of the flaps. In the illustrated embodiment, the slots extend approximately three-fourths of this distance. It should be noted, however, that the integrity of the bottom flaps is not entirely broken by the slot, a portion remaining between the outer end of the slots and the free edge of the bottom flaps. Score lines 43 extend from the outer end of the slots 41 to the free edge of the flaps. Each of the slots 41 include an enlarged area 45 located at a point along the slot axes approximately midway between the hinged edge of the flaps 29 and 31 and their free edges.

As viewed in FIG. 1, the facing surface becomes the inner surface in the completed carton. Right hand edges 47 and 49 of the bottom flaps 29 and 31 respectively preferably have a slight taper inwardly (in direction toward slot) from the hinged connection to the outer edge. Left hand edges 51 and 53 of the bottom flaps 29 and 31 respectively also are tapered, and in contrast to the outer edges, are severely tapered inwardly from the hinged connection to the outer edge, preferably by an angle A of 45° between the respective side edges and the respective hinged connections. Both these edges terminate in a small offset from the score lines defining the left side edges of the walls 15 and 17 respectively.

The minor portions 35 and 39 of the bottom flaps include score lines 55 and 57 which each lie in the angle between the slot axis and the hinge on the same side of each slot. These score lines intersect the apex of these angles and bisect them and thus form an angle B of 45° to cause them to parallel the edges 51 and 53 respectively. During the erection of the carton and the consequent folding of the bottom flaps, the score lines 55 and 57 become fold lines for fold portions 59 and 61 of the bottom flaps 29 and 31 respectively.

In the illustrated embodiment, the walls 15–18 are shown having approximately equal width. The resulting carton is therefore square. Although a square carton is primarily illustrated and described, this is only to simplify the illustration and description and it should be understood that the invention is applicable to cartons having walls of other dimensional relationships. For example, the side walls 15 and 17 could be much wider than the end walls 16 and 18 to result in a long, narrow (rectangular) shaped carton as illustrated in FIGS. 10 and 11. In such cartons, the terms major portions (33 and 37) are more easily understood because of the contrast in dimensions. The major portion is also referred to as the unfolded portion, and the minor portion as the folded portion. This will be understood in the erection procedure where it will be seen that folded portions 35 and 39 have parts 59 and 61 that are folded back on themselves, whereas the portions 33 and 37 have no such folded parts. The height of the walls determine the height of the carton, and this may be made convenient for the use intended. As far as this invention is concerned, the size of the carton may be arranged as desired within the range of the die cutting equipment of the manufacturer.

The carton is erected as depicted in FIGS. 2–7. As indicated previously, the glue flap 23 is provided to form a manufacturer's joint in connecting the outer edges of the walls 15 and 18 together. Thus, the blank 13 is used to form a tube or shell that is collapsed to provide a flat of parallel side and end walls all joined together end to end with transverse scoring between adjacent walls. In such condition, these flats are stacked and shipped to users.

The user then erects the carton by a simple two-step process. For convenience, simple instructions may be printed on the carton to inform the user as to the folding of the bottom panels to form the lock bottom. These instructions could include dots 63 on the outside of each of the major portions 33 and 37 of bottom flaps 29 and 31 as indicated in FIGS. 2–6. The instructions might also include bars or stripes 65 along the outsides of the score lines 55 and 57 as indicated in FIGS. 2–6.

As will be seen in the following description of the two steps, a principal advantage of this construction centers around the location of the user's hands as the carton is set up or erected. For both steps, the hands remain in one general location, i.e., the area of the bottom. In step 1, the palms of the hands are placed generally against the walls 15 and 17 with the left thumb against the dot 63 on the major portion 37 and the right thumb against the dot 63 on the major portion 33. The thumbs are then used to move the respective portions inwardly of the carton. Because of the bridge of material between each slot 41 and the respective free edges of the bottom flaps containing the slots, the respective panels follow in the folding procedure as indicated in FIGS. 2–4. Thus, the fold portions 59 and 61 first follow forming a fold along the score lines 55 and 57. After the initial fold is made during the continued inward movement of the major portions 33 and 37, the minor portions 35 and 39 follow as indicated in FIG. 4. This movement continues until the free side edges of the minor portions 35 and 39 bypass the edges 53 and 51 of the major portions 37 and 33 respectively to interlock internally thereunder as seen in FIG. 5. Step 1 is then complete.

For step 2, the hands are moved inwardly of the bottom to grip the fold lines at the stripes 65. The hands are then pulled together and outwardly in the direction indicated in FIG. 5 to complete the interlock shown in FIG. 6. The box can then be flipped over and is ready for immediate loading.

This structure results in a lock bottom box having a strong bottom. As will be understood from an examination of FIG. 7, which is a view of the inside bottom of the carton, there are three layers of carton material at the areas designated by 67 and 69, comprising, from the inside out, the major portions 33 and 37, immediately underneath which are the parts 59 and 61 folded back on the minor portions 35 and 39, respectively. The non-folded edges of the minor portions 35 and 39 overlap in interlocking relation the then opposing major portions 37 and 33 respectively. The straight edges defining the slots 41 provide squareness to the erected structure, and no glue, stitches, staples, or other fastening means are needed to maintain the erected carton with this strong lock bottom.

As many of these cartons are used as retrippers, this construction has particular advantage in allowing the carton to be quickly collapsed for stacking and reshipment in the flat state while leaving the carton in a condition to be quickly set up again by another user. To accomplish this collapse, substantially only one grip and motion is needed. As seen in FIG. 8, the palms of the hands are again placed so that the thumbs are on the dots 63. In the collapsing motion, the thumbs press downwardly to move the respective flaps inwardly, and at the same time the palms of the hands are moved toward one another as indicated by the heavy arrows. The interlocking relation of the flaps is thus maintained in this movement.

To re-erect the carton, a quick, easy process is again utilized. In FIG. 9, the carton is seen in its collapsed condition. The hands then grip the carton near the base of the arrows and move apart in the direction of the arrows. The hands then regrip at the stripes 65 and move together and upwardly as indicated in FIG. 5 to complete the operation. The carton, as before, is immediately ready for loading without the use of fastening means.

As indicated previously, this invention is applicable to long, narrow (rectangular) cartons as well. The outside bottom of such a carton constructed in accordance with the principles of this invention is shown in FIG. 10, a view which is equivalent to the bottom of the square carton seen in FIG. 6. The inside of this same rectangular carton of FIG. 10, is seen in FIG. 11. In both of these figures generally corresponding parts carry the same reference numbers with the subscripts "a" added.

There has been provided in accordance with this invention, a lock bottom carton having a perimeter of four connected walls having hinged top flaps and hinged bottom flaps folded and interlocked to form a closed, generally flat bottom. Two bottom flaps are included that are folded generally in the plane of the bottom. One is hingedly connected to one pair of adjacent walls and the other is hingedly connected to the other pair of adjacent walls. Each bottom flap includes a folded portion and an unfolded portion. The unfolded portion is hingedly connected to one of the walls of the pair of adjacent walls to which its bottom flap is connected. The folded portion is hingedly connected to the other of the walls. A division between these two portions occurs along a score line that extends transversely of the bottom flap and intersects the corner formed between the pair of walls to which the bottom flap is connected. The unfolded portion has a tapering free side edge that extends from a point along its (the unfolded portion's) hinge spaced from this corner and that is directed inwardly of the perimeter of the connected walls. The folded portion has a part that is folded internally of the carton back on itself along a fold line that forms one side edge of the fold portion and that is directed inwardly of the perimeter from this corner. The non-folded side edge of each folded portion internally overlaps the tapered free side edge of the opposing non-folded portion to thereby form a strong lock bottom without stitching, staples, glue or other fastening means. The bottom is thereafter pushable internally after use to collapse the carton for reshipment to another location for re-use. The lock bottom will automatically reform upon opening the carton from this collapsed for reshipment state.

Although this invention has been described in connection with a preferred embodiment, alternatives, modifications, and variations may be apparent to those skilled in the art in view of the foregoing description. Accordingly, it is intended to embrace all such alternatives, modifications, and variations as fall within the spirit and scope of the appended claims.

What is claimed is:

1. A lock bottom carton having a perimeter of four connected walls having hinged top flaps and hinged bottom flaps folded and interlocked to form a closed, generally flat bottom, the improvement comprising: a first bottom flap folded generally in the plane of the bottom and hingedly connected to one pair of adjacent walls and a second bottom flap folded generally in the plane of the bottom and hingedly connected to the other pair of adjacent walls, each said bottom flap comprising a folded portion and an unfolded portion, the unfolded portion being hingedly connected to one of the walls of the pair of adjacent walls to which its bottom flap is connected and the folded portion being hingedly connected to the other of the walls, a division between the folded and unfolded portions occurring along a score that extends transversely of the bottom flap and intersects the corner formed between the pair of walls to which the bottom flap is connected, the unfolded portion having a free tapering side edge that extends from a point along its hinge spaced from said corner and that is directed inwardly of the perimeter of the connected walls, and said folded portion having a part folded internally of the carton back on itself along a fold line that forms one side edge of the fold portion and that is directed inwardly of the perimeter from said corner, the non-folded side edge of each folded portion internally overlapping the free tapered side edge of the opposing non-folded portion, thereby forming a strong lock bottom in said carton without stitching, staples, glue or other fastening means, said bottom being pushable internally after use to collapse the carton for reshipment to another location for re-use, the lock bottom automatically reforming upon opening the carton from the collapsed state.

2. A carton in accordance with claim 1 further including an internal slot in each said bottom flap that extends along an axis that coincides with said score line that forms the division between the folded and the unfolded portions, said slot extending from said corner to a point that is more than half, but not the entire, distance to the free edge of the flap.

3. A carton in accordance with claim 2 further including an enlarged area in each said slot located at a point along the axis thereof that is approximately midway between the hinge and the free edge of the bottom flap containing the slot.

4. A carton in accordance with claim 1 wherein said tapering side edges and said tapering fold lines form an angle of 45° with the adjacent hinge connections.

5. A blank for forming a lock bottom carton, said blank including four connected walls defined by transverse score lines; a top flap hingedly connected along the top of each said wall; a glue flap hingedly connected to a free side edge of one of said walls; a first bottom flap hingedly connected to the bottom of one pair of adjacent walls; a second bottom flap hingedly connected to the bottom of the other pair of adjacent walls; an internal slot in each said bottom flap, the axis of said slot continuing from the score line between the pair of walls associated with the bottom flap containing said slot, said slot extending from the associated bottom flap hinge transversely of the flap for more than half the distance to, but not reaching, the free edge thereof; a tapering score line lying in and intersecting the apex of the angle between the axis of each said slot and the hinge connection on one side of said slot; and a tapering side edge on each said bottom flap on the other side of said slot from said score line, said side edge extending parallel to said score line from the hinge to the free edge of said bottom flap.

6. A blank in accordance with claim 5 further including an enlarged area in each said slot located at a point along the axis thereof that is approximately midway between the hinge and the free edge of the bottom flap containing the slot.

7. A blank in accordance with claim 5 wherein each said tapering score line bisects the angle between the axis of its associated slot and the hinge connection on one side thereof.

8. A blank in accordance with claim 5 wherein the axis of the slot is normal to the bottom hinge whereby said tapering score line and said tapering side edge each forms an angle of 45° with the hinge.

9. A blank in accordance with claim 5 in which a score line is provided along the slot axis between the outer end of said slot and the free edge of said bottom flap.

* * * * *